United States Patent [19]

Malola

[11] Patent Number: 4,460,948

[45] Date of Patent: Jul. 17, 1984

[54] UNIVERSAL LUMINAIRE MOUNT

[75] Inventor: Hane M. Malola, Crawfordsville, Ind.

[73] Assignee: National Service Industries, Atlanta, Ga.

[21] Appl. No.: 489,583

[22] Filed: Apr. 28, 1983

[51] Int. Cl.[3] ..... F21V 21/00

[52] U.S. Cl. ..... 362/396; 362/147; 362/362; 362/368; 362/382; 362/404; 362/418; 362/430; 362/431

[58] Field of Search ..... 362/147, 396, 362, 368, 362/404, 418, 430, 431, 382

[56] References Cited

U.S. PATENT DOCUMENTS

| | | | |
|---|---|---|---|
| 1,559,580 | 11/1925 | Murray . | |
| 2,943,137 | 6/1960 | Van Wyngarden | 174/61 |
| 3,919,459 | 11/1975 | Van Steenhoven | 174/63 |
| 4,167,033 | 9/1979 | Fletcher | 362/368 X |
| 4,173,037 | 10/1979 | Henderson | 362/368 X |
| 4,219,868 | 8/1980 | Bowman | 362/147 |
| 4,219,869 | 8/1980 | Bowman | 362/147 |
| 4,286,313 | 8/1981 | Quiogue | 362/370 |
| 4,363,086 | 12/1982 | Fletcher | 362/368 |

*Primary Examiner*—Stephen J. Lechert, Jr.
*Attorney, Agent, or Firm*—Emch, Schaffer & Schaub

[57] ABSTRACT

The invention relates to an improved universal mounting for industrial luminaires fixtures containing high intensity discharge lamps. The luminaire mount of the present invention is adaptable to most of the accepted modes of mounting luminaries as specified in the National Electric Code. The luminaire mount includes a plate providing horizontal adjustment of the luminaire. The luminaire mount provides for enhanced safety during installation and maintenance. All current to the luminaire must be broken and the luminaire deenergized prior to removal from the mount.

16 Claims, 4 Drawing Figures

UNIVERSAL LUMINAIRE MOUNT

BACKGROUND OF THE INVENTION

This invention relates to an improved apparatus for mounting luminaire fixtures and supplying electrical power to their lamps. Many luminaire fixtures designed for use in today's industrial environment utilize high intensity discharge lamps, such as high pressure sodium lamps, mercury vapor lamps, and metallic vapor lamps, to provide illumination because such lamps generally offer increased efficiency and enhanced photometric distribution. However, the increasing application of such high intensity discharge lamps in varied industrial settings has created certain adaptability problems for the suppliers of such luminaire fixtures. As a result, there is an increasing demand for a luminaire fixture offering a combination of features which make it capable of adapting to a diverse variety of applications as well as a luminaire fixture which provides an enhanced safety environment for its installation and maintenance.

Luminaire fixtures can be mounted in many different ways in order to meet the specific design applications of a certain industrial setting. It is common to find luminaire fixtures mounted in a pendant mode, either directly fixed to a wire carrying conduit or hung on a hook or loop support member which engages a complimentary loop or hook member located on the luminaire fixture. Other methods of mounting include direct attachment of the luminaire fixture to a support member of the building structure, such as the ceiling, and thru mounting, as specified in the National Electric Code, wherein the luminaire fixture engages a wire carrying conduit which extends horizontally between at least two luminaire fixtures. Many of the luminaire fixtures currently available offer only one or a partial combination of these accepted alternative methods of mounting. For instance, the luminaires of U.S. Pat. Nos. 4,219,868 and 4,219,869 disclose the use of the various modes of pendant mounting, such as the hook, loop and direct pendant mount. No provision is made in these fixtures for thru mounting or direct mounting. The luminaire mount disclosed in U.S. Pat. No. 3,919,459 discloses the use of various modes of pendant mounting, such as the hook, loop, and direct pendant mount. The design of the luminaire mount further includes a direct mounting feature. Again, no provision is made for the widely accepted practice of thru mounting. The luminaire mount of the present invention improves upon these designs by alternatively providing for *all* the various mounting modes including thru mounting, either singularly or in combination, without need to make major modifications in the luminaire fixture or return to the stock shelf to obtain a different model having the desired mounting feature.

Another problem encountered with many current luminaire fixtures occurs during pendant mounting of the fixture. Most luminaire fixtures are not manufactured with uniform weight distribution around the pendant attachment point. In many large industrial type luminaires, the capacitor and transformer contained in the ballast are not equally balanced around the center point, thus causing the luminaire fixture to tilt from its preferred vertical orientation. Of course, any degree of tilt from the preferred vertical orientation is undesirable since the desired light pattern and photometric distribution will be deleteriously affected. U.S. Pat. Nos. 4,219,868, 4,219,869 and 3,919,459 offer a solution to this problem by providing for linear adjustment of the luminaire hook, loop or direct pendant member to assist in providing desired vertical orientation. U.S. Pat. No. 4,268,313 provides a pivotally mounted cap on the top of the luminaire fixture which can be pivoted to change the center of gravity of the fixture to provide proper vertical orientation. The present invention improve upon these designs by providing a mounting plate which slideably engages the luminaire fixture to provide a large surface area of support and assist in balancing the luminaire fixture in its desired vertical orientation.

Other problems encountered with many current luminaires result from the heavy weight of large industrial-type luminaires. During the mounting and installation of such heavy luminaires, it has been found that the installer encounters problems in simultaneously balancing the weight of the luminaire and making the appropriate electrical connections. The present invention provides assistance in such troublesome installation areas by separating the junction box for the luminaire fixture from the ballast, fuses, reflector and lamp, and placing the junction box in a central housing. The central housing can be mounted and all initial electrical connections made before installation of the remainder of the fixture, thus facilitating ease of installation.

Applicant's present invention provides a luminaire mount with universal applicability to most of the accepted modes of mounting while further providing for ease in installation of the luminaire fixture in its desired vertical orientation. Applicant's invention further provides for enhanced safety during installation and maintenance of the high intensity discharge lamps and the luminaire fixture. High intensity discharge lamps used in the industrial setting usually operate with high electrical voltage and strong passing currents. Frequently required maintenance such as cleaning of the lamp and reflector, replacement of bulbs, etc., can be potentially dangerous. The present invention provides for increased safety during such maintenance as well as during installation in that all electrical connections are made within the central housing which is individually mounted. After all electrical connections have been made in the central housing, the ballast housing, reflector and lamp are mounted on the central housing without making an electrical connection. Only after the ballast housing, reflector and lamp have been secured on the central housing and balanced in the desired manner, does installer or maintenance man connect a fuse housing, containing at least one fuse member, with the central housing and the ballast housing to provide the electrical connection between the central housing and the ballast housing, thereby energizing the luminaire. The fuse housing receives the high voltage electric current supplied to the central housing through its interconnection with the central housing and passes the high voltage current on to the ballast housing which in turn acts to energize the luminaire. The fuse housing, the ballast housing and the central housing are interconnected in a specific manner which provides that the ballast housing, reflector and lamp cannot be removed from the central housing and the electrical connections cannot be broken without first removing the fuse housing.

Applicant's invention therefore provides for a mounting apparatus for use with industrial luminaires having universal application to many accepted mounting holes which meet the standards of the National Electric Code. The present invention includes an adjustable mounting plate to assist in supporting and balancing the luminaire fixture in its desired vertical orientation. The luminaire mount of the present invention provides for increased safety during installation and maintenance of the luminaire by assuring that the ballast housing, reflector and high intensity discharge lamp are not removable from the mounting without first de-energizing the high intensity discharge lamp by breaking the supply of high voltage current to the lamp.

SUMMARY OF THE INVENTION

This invention provides a mounting apparatus for attaching an industrial luminaire having a high intensity discharge lamp to a support member of a building structure. The mounting apparatus is adaptable for application to many practiced modes for mounting luminaires and further provides for enhanced safety in the installation and maintenance of the mounted luminaires fixture.

The mounting apparatus of the present invention provides a central housing which is attached to a support member of a building structure and is connected to electrical wires extending from the required source of electricity. The central housing can be mounted in any of the accepted modes for mounting luminaires, including pendant mounting, thru mounting, hook mounting, loop mounting and flush mounting. For the purposes of pendant mounting, hook mounting and loop mounting the central housing also provides a mounting plate which engages the central housing. The central housing is moveable on the mounting plate to provide the proper center of gravity and balance for the ballast housing, lamp and reflector. This provides the desired weight distribution so that the luminaire fixture is installed and suspended in its desired vertical orientation.

The structure of the mounting apparatus of the present invention enhances worker safety during installation and maintenance of the luminaire fixture. The central housing contains a terminal to which the electric wires running from the source of electricity are connected. The terminal is in communication with a female electrical plug fixed to one end of the central housing. After the central housing is mounted and connected to the electrical wires the ballast housing which contains the transformer and capacitor and to which the reflector and lamp are attached is interconnected with the central housing without making an electrical connection between the central housing, ballast, or lamp. Only after the ballast housing is fixed in place with the central housing, can the electrical connection be made between the central housing and the ballast to energize the lamp. This electrical connection is accomplished through use of a fuse housing which is plugged into the female plug of the central housing to receive the high voltage current and direct the current to the ballast housing, thereby energizing the lamp. A resilient two-step retaining clip is employed to interconnect the ballast housing and the fuse housing with the central housing. After installation, the ballast housing, reflector and lamp cannot be removed from the central housing without first disengaging the fuse housing and thereby deactivating the supply of electricity to the ballast housing and lamp.

Further safety is provided by structure of the present invention which limits access to the fuses contained in the fuse housing while the fuse housing is receiving electrical current from the central housing. Once the fuse housing is connected with the the central housing and receiving high voltage current the fuses are inaccessible. Should access to the fuse members be needed for replacement or for maintenance of the luminaire fixture, the fuse housing must be removed from the central housing and the supply of electricity broken.

Accordingly, it is an object of the invention to provide an improved mounting apparatus capable of adapting to most electrical mounting standards as specified in the National Electric Code for use in the industrial environment.

Another object of the invention is to provide for an improved ease of installation of an industrial luminaire fixture.

Yet another object of the invention is to provide for increased safety during installation and maintenance of the luminaire fixture.

Other objects and advantages of the invention will become apparent from the following detailed description with reference being made to the accompanying drawings.

DETAILED DESCRIPTION OF THE DRAWINGS

Figure 1:
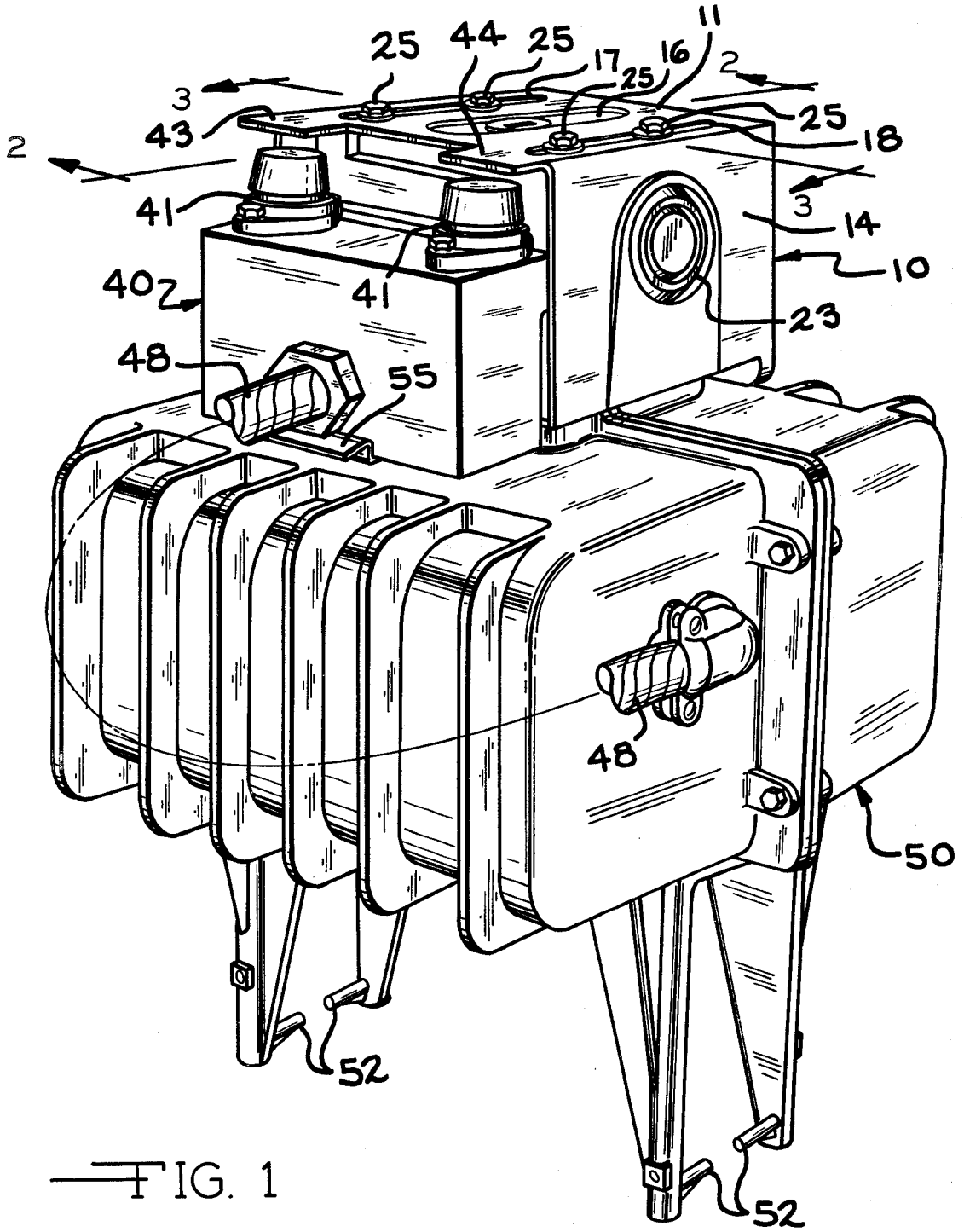
FIG. 1 is a perspective view of the present invention showing the fuse housing and ballast housing interconnected with the central housing.

Referring now to the drawings, the preferred embodiment of the present invention will be fully described. Turning to FIG. 1, the luminaire mount of the present invention is shown in a isometric embodiment. Generally, the mount comprises a central housing 10, a fuse housing 40 and a ballast housing 50. The central housing 10 mounts the luminaire fixture to a support member of a building structure in one of the standard industrial mounting modes or in a combination of modes, if desired. The central housing 10 also connects the high intensity discharge lamp of the luminaire fixture with a source of high voltage electricity (not shown). The fuse housing 40 interconnects with the central housing 10, receives the high voltage electricity from the central housing 10 and directs the electricity to the ballast housing 50 through wiring contained in the flexible conduit 48. The ballast housing 50 usually contains, for example, a known capacitor and transformer (not shown) which are needed to energize the lamp. The ballast housing 50 receives electricity from the fuse housing 40 and central housing 10 and energizes the lamp (not shown) which is attached to the ballast housing 50 by four brackets 52.

Figure 2:
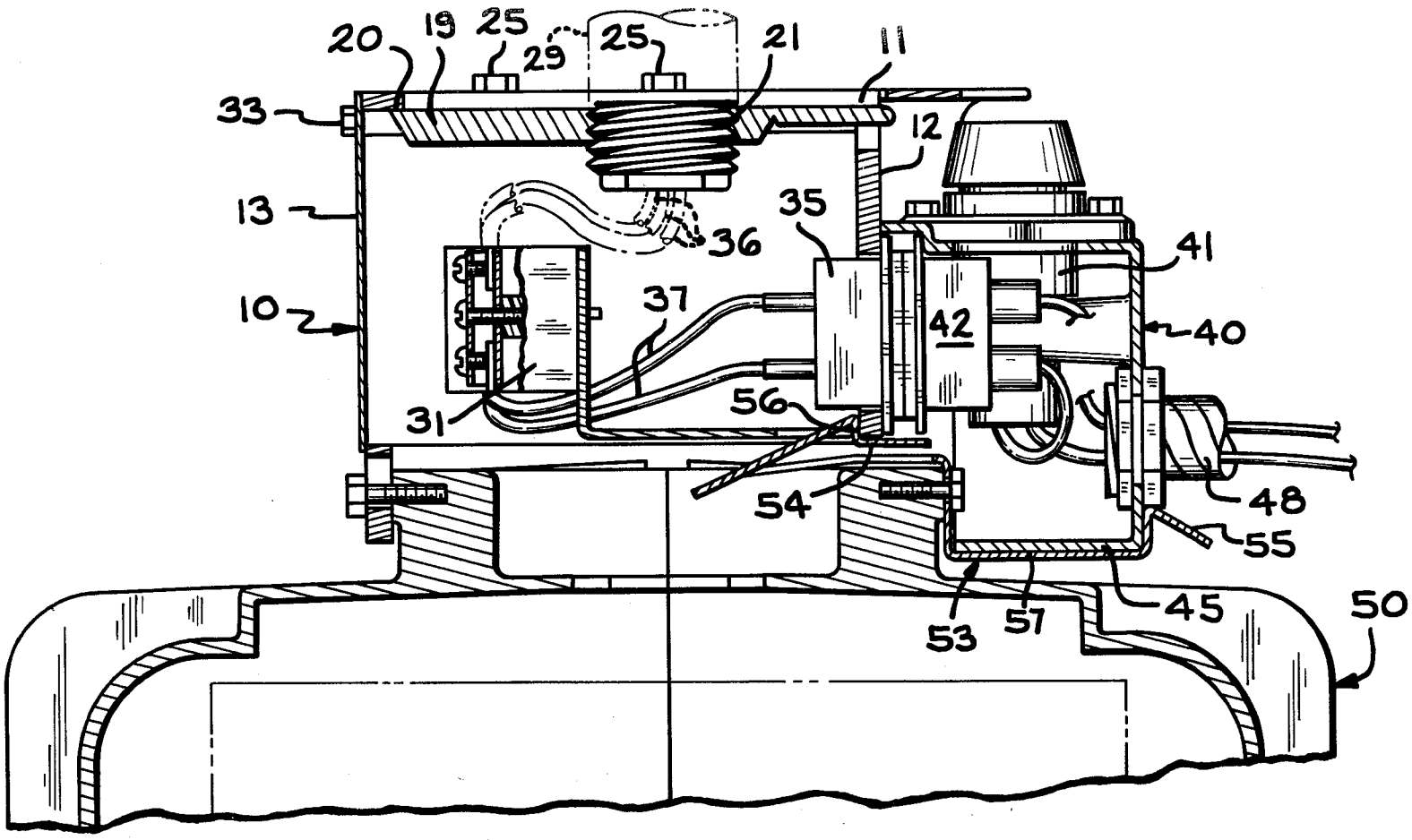
FIG. 2 is a cutaway view along line 2—2 of FIG. 1.
Figure 3:
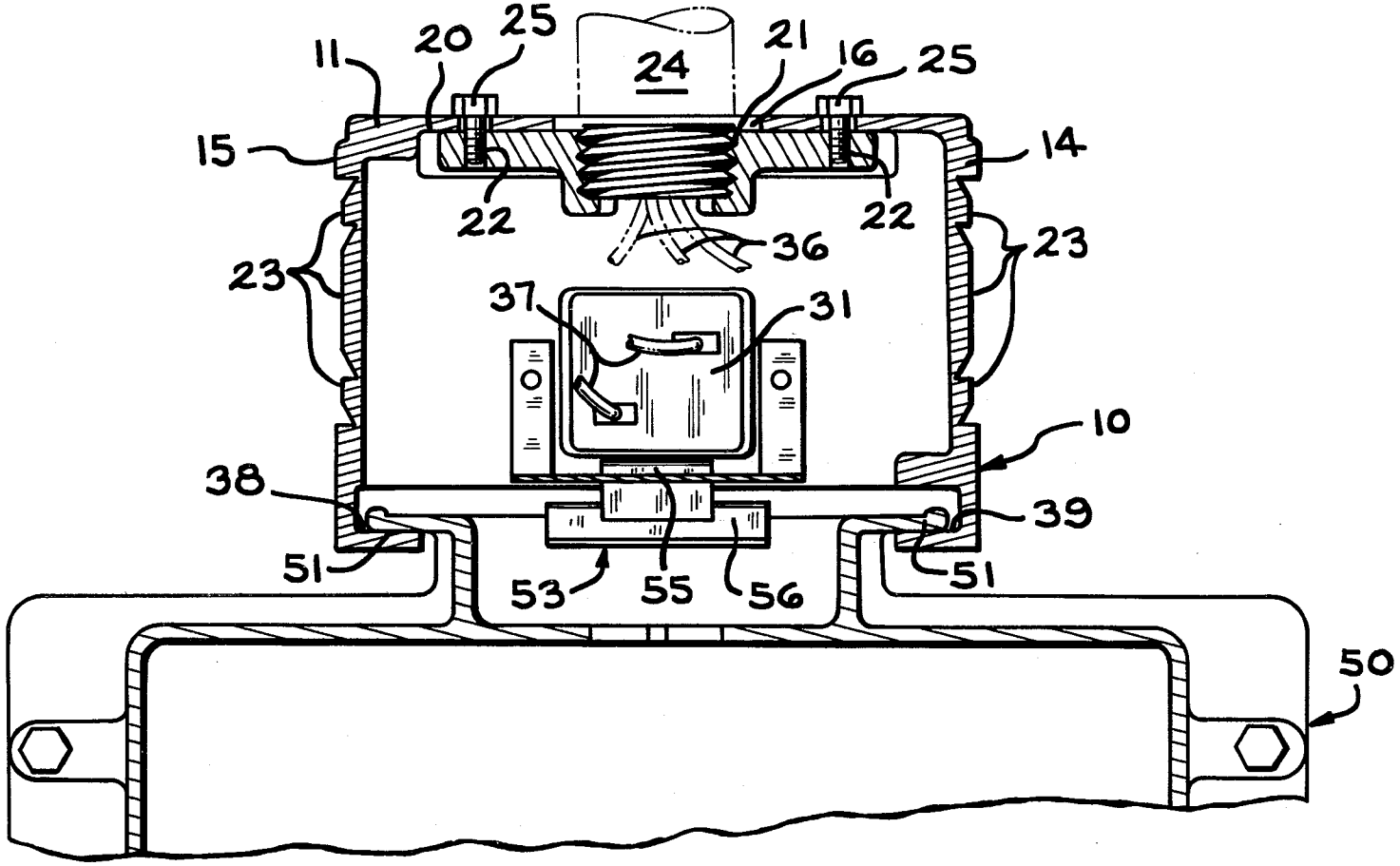
FIG. 3 is a cutaway view along line 3—3 of FIG. 1.
Figure 4:
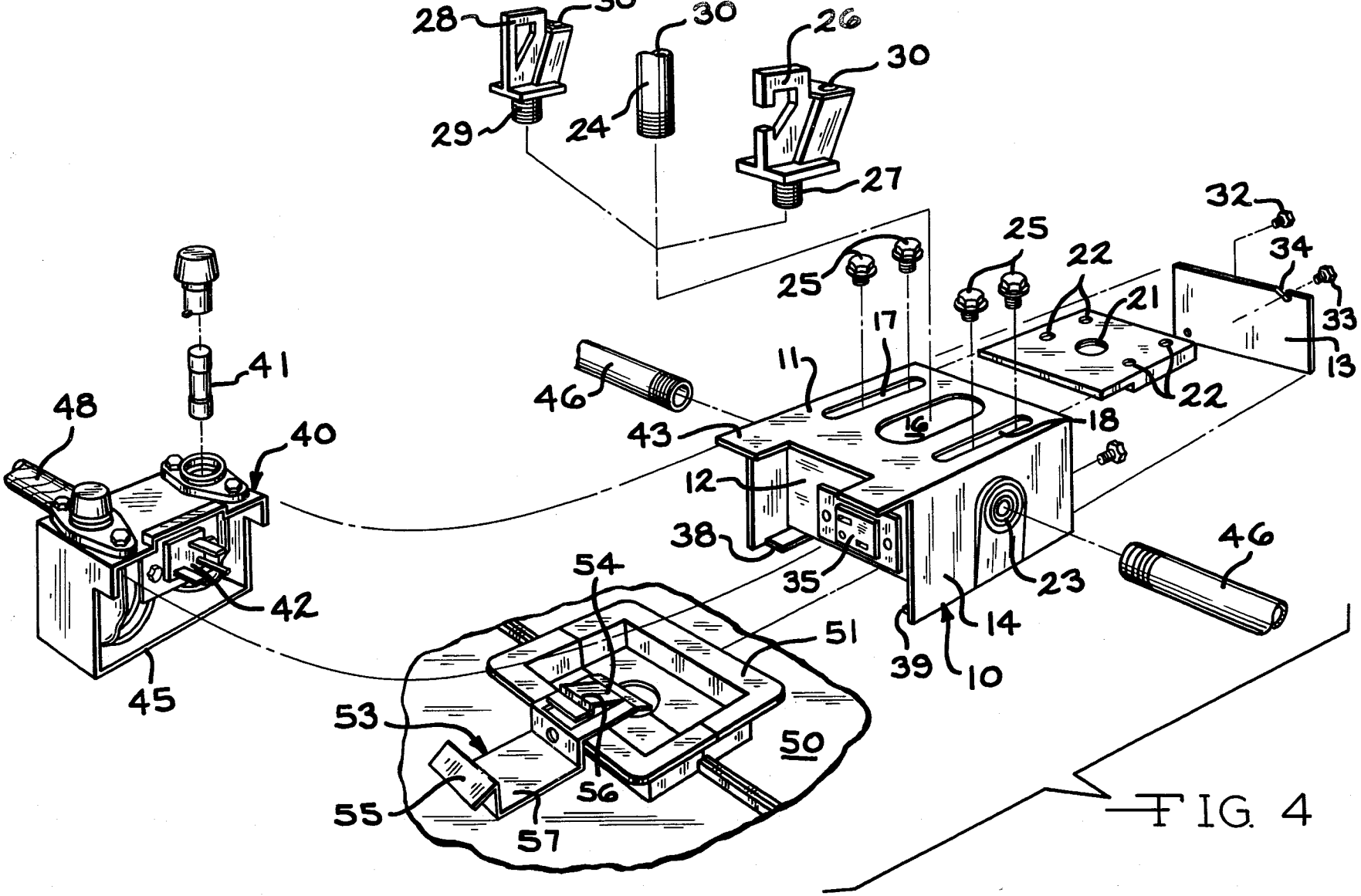
FIG. 4 is an exploded view of the central housing of the present invention showing the various modes for attaching the central housing to a support member, the fuse housing, and the resilient two-step retaining clip for attaching the ballast housing and fuse housing to the central housing.

Referring now to FIGS. 2, 3, and 4, it can be seen that the central housing provides a wide variety of modes for attachment of the luminaire fixture to a support member of a building structure. The central housing 10 includes an top member 11, a front wall 12, a rear wall 13, a first sidewall 14 and a second sidewall 15. Centrally located in the top member 11 is an elongated slot 16 and positioned on opposed sides of the central elongated slot 16 are a first mounting slot 17 and a second mounting slot 18. A mounting plate 19, adapted to slideably engage under surface 20 of the top member 11, includes a centrally located threaded aperture 21 and four threaded mounting holes 22. The threaded aperture 21 is aligned with the central elongated slot 16 of the top member 11 and the threaded mounting holes 22 are aligned in pairs with the first mounting slot 17 and the second mounting slot 18 of the top member 11. The central housing 10 further includes knockout rings 23 of various diameters located in the first and second sidewalls 14, 15.

Referring to FIG. 4, the various modes of attaching the central housing 10 to a support member of a building structure are alternatively shown. To mount the central housing 10 flush against the support member of a building structure, such as the ceiling, the mounting plate 19 is removed from engagement with the top member 11 of the central housing 10 and the top member 11 of the central housing 10 is secured flush against the ceiling with four screws or bolts. However, in most industrial applications the ceilings are quite high and the luminaire must be hung a specified distance below the ceiling and above the floor to provide for total photometric distribution and minimum direct lamp glare. To achieve this effect, the luminaire fixture is pendant mounted from the ceiling. In one mode of pendant mounting, a threaded wire carrying conduit 24, such as a pipe, is extended downward from the ceiling to a specified distance above the floor. To securely attach the central housing 10 to such a threaded conduit 24, the mounting plate 19 is engaged with the under surface 20 of the top member 11 and secured by four mounting bolts 25 which extend through the first and second mounting slots 16, 17 and engage the threaded mounting holes 22 of the mounting plate 19. The threaded conduit 24 is received by the threaded aperture 21. The mounting bolts 25 will slide in the mounting slots 16, 17 and the threaded conduit 24 will slide in the central elongated slot 16 to allow the central housing 10 to move on the mounting plate 19 to position and balance the luminaire fixture in the desired vertical orientation.

In another mode of pendant mounting, the support member includes a hook or loop to which the central housing 10 must be attached. If the support member is a loop the invention provides a complimentary hook member 26, for engaging the support loop, having a threaded portion 27 which is received by the threaded aperture 21 of the mounting plate 19, thereby securing the top member 11 of the central housing 10 to the hook member 26. Should the support member have a hook to which the central housing 10 must be attached the invention provides a complimentary loop member 28, for engaging the support hook, having a threaded portion 27 which is received by the threaded aperture 21 of the mounting plate 19, thereby securing the top member 11 of the central housing 10 to the loop member 28.

Yet another commonly accepted method for mounting luminaires is thru mounting wherein conduits 46 interconnect a plurality of luminaires. Generally the thru mounting is achieved by running the conduits 46 completely through the sidewalls 14, 15 of the central housing 10. The knockout rings 23 located in the sidewalls 14, 15 of the central housing 10 are removed and the conduit 46 is mounted through the remaining aperture. Commonly, the conduit is threaded and the apertures receive the threaded conduit 46. The present invention provides knockout rings 23 of varying diameters to provide suitable apertures for the various sizes of threaded conduit 46 commonly used in such installations (i.e., $\frac{3}{4}''$ or $1\frac{1}{4}''$ conduit). Of course, the thru mounting mode may be used in combination with one of the other mounting modes, if the structural design so requires.

A serious problem sometimes occurs when mounting the luminaire fixtures in a pendant mode and the ballast housing 50, reflector and lamp are not balanced around the center point of the pendant mounting. Non-uniform weight distribution of the ballast housing 50, reflector and lamp can cause the luminaire fixture to tilt or hang in manner outside of its desired vertical orientation. To compensate for this problem, the mounting plate 19 is slideably engages the under surface 20 of the top member 11 of the central housing 10. During installation the mounting plate 19 is attached to the support member in one of the pendant mounting modes. The mounting bolts 25 are loosely secured through the mounting slots 17, 18 to the mounting holes 22 to allow the worker to slide the central housing 10 and attached ballast housing 50, reflector and lamp on the mounting plate 19 thereby providing the desired plumb orientation for the luminaire fixture. Once plumb orientation of the luminaire fixtures is achieved the mounting bolts 25 may then be securely tightened to provide secure attachment between the mounting plate 19 and the central housing 10.

Referring now to FIG. 2, the method for connecting the central housing 10 with electrical wiring 36 from the source of electricity can be described. In most mounting applications, the electrical wiring 36 extending from the source of electricity (not shown) is provided in cooperation with the support member of the building structure. For instance, referring now to FIG. 4, during pendant mounting the electrical wiring 36 extends through the longitudinal bore 30 of the threaded conduit 24 and extends through the elongated slot 16 and threaded aperture 21 into the central housing 10. In the hook and loop mounting modes, the hook member 26 and loop member 28 are provided with longitudinal bores 30 which extend from a position proximate the hook or loop to the threaded portion 27 of the hook or loop member. The electrical wiring 36 extends through the longitudinal bore 30, the elongated slot 16 and the threaded aperture 21 into the central housing 10. In the thru mounting mode the electrical wiring 36 in most applications, will extend through the threaded conduit into the central housing 10.

Referring to FIG. 2, the interior of the central housing 10 is provided with an electrical terminal 31. The electrical wires 36 extending into the central housing 10 are fastened directly to the terminal 31. Access to the interior of the central housing 10 to effect the connection of the electrical wires to the terminal is provided by removal of the rear wall 13. In the present invention, the rear wall 13 is attached by a first wall screw 32 which secures a lower corner of the rear wall 13. A second wall screw 33 secures the upper corner of the rear wall 13 and is juxtaposed to the first wall screw 32. An angularly disposed slot 34 located in the rear wall 13 engages the second wall screw 33. When the first wall screw 32 and second wall screw 33 are not tightened, the angular slot 34 provides for rotation of the rear wall 13 downward around the first wall screw 32, thereby providing access to the interior of the central housing 10. The rear wall 13 may be secured into position by tightening the first wall screw 32 and tightening the second wall screw 33 when the second wall screw 33 is in communication with the angular slot 34.

Referring to FIG. 2, the preferred embodiment of the present invention provides for a female electrical plug 35 to be located in the front wall 12 of the central housing 10. The female plug 35 is in electrical communication with the terminal 31 through plug wires 37. Once the electrical wires 36 are connected with the terminal 31, the female plug 35 will receive electrical current from the source of electricity through the terminal 31 and plug wires 37.

The present invention provides for universal adaptability with many of the mounting modes used in the installation of industrial luminaires fixtures. The present invention also provides for increased ease in installation as the central housing may be installed and connected with the electrical wiring without necessitating the simultaneous installation of the ballast housing, reflector and lamp. Further, the present invention provides for enhanced safety during installation and maintenance of the industrial luminaire in that all installation and electrical connections are completed prior to the attachment of the ballast housing, reflector and lamp to the central housing. Safety in installation and maintenance is further enhanced in that a specific installation procedure must be followed to install the remainder of the ballast housing, fuse housing, reflector and lamp. The ballast housing must be affixed to the central housing prior to the interconnection of the fuse housing with the central housing. The ballast housing will receive no electricity until the fuse housing is interconnected with the central housing. Therefore, the ballast housing is installed, the luminaire fixture balanced, and all preparations completed before the fuse housing is installed. Once the fuse housing is installed, the ballast housing and luminaire assembly cannot be removed from the central housing without first disengaging the fuse housing from the central housing.

Referring now to FIGS. 2, 3 and 4, ballast housing 50 includes a lip 51 which is designed to engage a first slot 38 located at the bottom of the first sidewall 14 and a second slot 39 located at the bottom of the second sidewall 15. The ballast housing 50 also includes a resilient retaining clip 53 having a first tab 54 and a second tab 55. The first tab 54 is angularly disposed upward from the surface of the retaining clip 53. A first retaining surface 56 is located proximate the end of the first tab 54.

Referring now to FIG. 2, the position of the first tab 54 when the ballast housing 50 is interconnected with the central housing 10 is shown. As the ballast housing 50 is slid into its interconnected final position with the central housing 10, the lip 51 of the ballast housing 50 engages the first and second slots 38, 39 of the first and second sidewalls 14, 15 and the first tab 54 is resiliently pressed downward by the front wall 12 of the central housing 10. When the ballast housing 50 reaches its final position of interconnection with the central housing 10, the first retaining surface 56 of the first tab 54 engages the inside of the front wall 12 of the central housing 10 to lock the ballast housing 50 into its interconnected position with the central housing 10. To disengage the first retaining surface 56 from the front wall 12 of the central housing 10, the portion of the first tab 54 projecting out from the front wall 12 must be pressed downwardly to slide the first retaining surface 56 below the front wall 12, thereby disengaging the first retaining surface 56 from the front wall 12 and allowing the ballast housing 50 so to be removed from the central housing 10.

Referring now to FIG. 4, the fuse housing 40 is shown having two fuse members 41 which are in communication with a male plug member 42 and the flexible conduit 48. To interconnect the fuse housing 40 with the central housing 10 the male plug member 42 is received by the female plug member 35 located in the front wall 12 of the central housing 10. Once the male plug member 42 and female plug member 35 are interconnected, the electric current received by the central housing 10 from the source of electricity will be directed through the fuse members 41 and the flexible conduit 48 into the ballast housing 50 to energize the high intensity discharge lamp (not shown). The fuse members 41 may not be tampered with or removed from the fuse housing 40 when the fuse housing 40 is interconnected with the central housing 10. The top member 11 of the central housing 10 includes a first lip 43 and a second lip 44 which extend from the top member 11 over the fuse members 41. Thus, the lips 43, 44 prevent access to or removal of the fuse members 41 from the fuse housing 40 until the fuse housing 40 is disengaged from the central housing 10 and all electrical connections are broken. Thus, there can be no electrical shock to the installation or maintenance personnel upon removal of fuse members 41.

Referring now to FIG. 2, the second tab 55 of the retaining clip 53 is provided with a U-shaped member 57 adapted to receive the bottom 45 of the fuse housing 40 when the fuse housing 40 is interconnected with the central housing 10. Once the fuse housing 40 is interconnected with the central housing 10 and the male plug member 42 is in communication with the female plug member 35, access to the first tab 54 of the retaining clip 53 is prevented, thereby preventing removal of the ballast housing 50, reflector and lamp while the fuse housing 40 is engaged with the central housing 10. This aspect of the present invention assures that the ballast housing 50, reflector and lamp may not be removed from the central housing 10 while receiving electrical current from the source of electricity. Only after the fuse housing 40 has been disengaged from the central housing 10, thereby breaking all electrical connection, can the ballast housing 50, reflector and lamp be removed.

It will be appreciated that various changes and modifications may be made in the above described luminaire mount without departing from the spirit and scope of the following claims.

What I claim is:

1. A mounting apparatus for attaching luminaires to a support member of a building structure and connecting such luminaires with a source of electricity comprising, in combination:

a central housing member having means to attach such luminaire to such support member and means to connect with such source of electricity;

a ballast housing adjacent with said central housing and detachable therefrom;

a fuse housing having at least one fuse member interconnected between said central housing and said ballast housing, said fuse housing being in communication with said ballast housing whereby said fuse housing receives electricity from such source of electricity through said central housing and directs such electricity to said ballast housing; and means for interconnecting said fuse housing and said ballast housing with said central housing, said interconnection means including means to interlock said fuse housing and said ballast housing with said central housing whereby said fuse housing must be detached from said central housing prior to detaching said ballast housing from said central housing.

2. The mounting apparatus of claim 1, wherein said central housing includes a top member, and mounting plate means engagable with such support member positioned for relative movement adjacent said top member whereby the horizontal position of such luminaire may be adjusted.

3. The mounting apparatus of claim 1 wherein said top member of said central housing includes an elongated slot centrally located therein and first and second mounting slots, positioned on opposed sides of said central elongated slot, said mounting plate means adapted to slideably engage said top member of said central housing and having a threaded aperture located to communicate with said central elongated slot when said mounting plate is engaged with said top member of said central housing, said mounting plate further having at least one first mounting screw located to correspond with said first mounting slot and at least one second mounting screw located to correspond with said second mounting slot when said mounting plate is engaged with said top member of said central housing.

4. The mounting apparatus of claim 3 wherein said connecting means of said central housing includes a terminal for receiving electrical wires from such source of electricity.

5. The mounting apparatus of claim 4 wherein said attaching means of said central housing includes a hook-shaped member having a first end threaded to engage said threaded aperture of said mounting plate and a hook-shaped end opposed to said first end for engaging such support member said hook-shaped member further having a bore extending longitudinally therethrough wherein such electrical wires extend through said bore and said threaded aperture and said elongated slot to connect with said terminal.

6. The mounting apparatus of claim 4 wherein said attaching means of said central housing includes a loop-shaped member having a first end threaded to engage said threaded aperture of said mounting plate and a loop-shaped end opposed to said first end for engaging such support member said loop-shaped member further having a bore extending longitudinally therethrough wherein such electrical wires extend through said bore and said threaded aperture and said elongated slot to connect with said terminal.

7. The mounting apparatus of claim 4 wherein said threaded aperture of said mounting plate receives such threaded support member to attach such luminaire to such support member, such support member having a bore extending longitudinally therethrough wherein such electrical wires extend through said bore and said threaded aperture and said elongated slot to connect with said terminal.

8. The mounting apparatus of claim 4 wherein said central housing further includes a receptacle for receiving a plug member, said receptacle being in communication with said terminal to receive electricity from such source of electricity and said fuse housing further includes a plug member for engaging said receptacle when said fuse housing is interconnected with said central housing.

9. The mounting apparatus of claim 8 wherein said top member of said central housing further includes at least one lip member projecting over said fuse housing when said fuse housing is interconnected with said central housing, wherein access to said fuse member is precluded by said lip member when said fuse housing is interconnected with said central housing.

10. The mounting apparatus of claim 9 wherein said means for interconnecting said fuse housing and said ballast housing with said central housing includes a resilient two-step retaining means fixed to said ballast housing, said retaining means having a first tab member adapted to engage said central housing and interconnect said ballast housing with said central housing and a second tab member adapted to engage said fuse housing and interlock said fuse housing with said ballast housing when said fuse housing is interconnected with said central housing, whereby said fuse housing must be disengaged from said second tab member and removed from interconnection with said central housing before said ballast housing and said first tab member are disengaged from said central housing.

11. The mounting apparatus of claim 1 wherein said central housing includes an a top member, a front wall extending down from said top member, a rear wall opposed to said front wall extending down from said top member, a first side wall adapted to join said front wall, top member, and rear wall, and a second sidewall opposed to said first sidewall adapted to join said front wall, upper surface, and rear wall, said sidewalls each including a plurality of circular knockout means of varying diameters for providing circular apertures of varying diameters, whereby said circular apertures receive such support members of a building structure to attach such luminaire to such support members.

12. The mounting apparatus of claim 11 wherein said connecting means of said central housing includes a terminal for receiving electrical wires from such source of electricity.

13. The mounting apparatus of claim 12 wherein such support members each include a bore extending longitudinally therethrough, and such electrical wires extend through said bores and said circular apertures to connect with said terminal.

14. A mounting apparatus for attaching luminaires to a support member of a building structure and connecting such luminaires with a source of electricity comprising:

a central housing member including a top member having an elongated slot centrally located therein and first and second mounting slots positioned on opposed sides of said central elongated slot, a mounting plate adapted to slideably engage said top member of said central housing having a threaded aperture located to communicate with said central elongated slot when said mounting plate is engaged with said top member of said central housing, means to attach said central housing to such a support member positioned in said threaded aperture, and a terminal for receiving electrical wires from such source of electricity;

a ballast housing interconnected with said central housing and detachable therefrom;

a fuse housing having at least one fuse member interconnected with said central housing and detachable therefrom, said fuse housing being in communication with said terminal of said central housing and said ballast housing whereby said fuse housing receives electricity from said terminal and directs such electricity to said ballast housing;

a means for interconnecting said fuse housing and said ballast housing with said central housing including a resilient two-step retaining clip fixed to said ballast housing, said retaining clip having a first tab member adapted to engage said central housing and interconnect said ballast housing with said central housing and a second tab member adapted to engage said fuse housing and interlock said fuse housing with said ballast housing when said fuse housing is interconnected with said central housing, whereby said fuse housing must be disengaged from said second tab member and removed from interconnection with said central housing before said ballast housing and said first tab member are disengaged from said central housing.

15. The mounting apparatus of claim 14 wherein such electrical wires project through said threaded aperture and elongated central slot and are received by said terminal of said central housing.

16. A mounting apparatus for attaching luminaires to a support member of a building structure and connecting such luminaires with a source of electricity comprising:

a central housing member having a top member, a front wall extending down from said top member, a rear wall opposed to said front wall extending down from said top member, a first side wall adapted to join said front wall, top member, and rear wall, and a second sidewall opposed to said first sidewall adapted to join said front wall, top member and rear wall, said sidewalls each including a plurality of circular knockout means of varying diameters for providing circular apertures of varying diameters, whereby said circular apertures receive such support members to attach such luminaire to such support members, and a terminal for receiving electrical wires from such source of electricity;

a ballast housing interconnected with said central housing and detachable therefrom;

a fuse housing having at least one fuse member interconnected with said central housing and detachable therefrom, said fuse housing being in communication with said terminal of said central housing and said ballast housing whereby said fuse housing receives electricity from said terminal and directs such electricity to said ballast housing;

a means for interconnecting said fuse housing and said ballast housing with said central housing including a resilient two-step retaining clip fixed to said ballast housing, said retaining clip having a first tab member adapted to engage said central housing and interconnect said ballast housing with said central housing and a second tab member adapted to engage said fuse housing and interlock said fuse housing with said ballast housing when said fuse housing is interconnected with said central housing, whereby said fuse housing must be disengaged from said second tab member and removed from interconnection with said central housing before said ballast housing and said first tab member are disengaged from said central housing.

* * * * *